US006039489A

United States Patent [19]

Harman et al.

[11] Patent Number: 6,039,489

[45] Date of Patent: Mar. 21, 2000

[54] PASTE DISPENSING BRUSH

[75] Inventors: James N. Harman, Brielle, N.J.; Richard J. Upcavage, Fairless Hills, Pa.

[73] Assignee: ICP Corporation, Brielle, N.J.

[21] Appl. No.: 09/199,362

[22] Filed: Nov. 25, 1998

Related U.S. Application Data

[60] Provisional application No. 60/066,529, Nov. 25, 1997.

[51] Int. Cl.[7] ..... B43K 5/02

[52] U.S. Cl. ..... 401/146; 401/150

[58] Field of Search ..... 401/146, 149, 401/150, 171, 176, 179, 180

[56] References Cited

U.S. PATENT DOCUMENTS 4,692,047 9/1987 Endo ..... 401/150 X 5,158,383 10/1992 Glover et al. ..... 401/150

5,393,153 2/1995 Bouthillier et al. ..... 401/150 X

FOREIGN PATENT DOCUMENTS 3514600 8/1986 Germany ..... 401/150

*Primary Examiner*—David J. Walczak

*Attorney, Agent, or Firm*—Lerner, David, Littenberg, Krumholz & Mentlik, LLP

[57] ABSTRACT

A paste dispensing brush includes a paste reservoir and a reciprocating pump for dispensing paste on to the brush. The pump includes a housing defining a hollow stem and a housing cavity with a piston mounted for reciprocating movement within the cavity. The piston separates the housing cavity into a pumping chamber portion and a dry portion. The paste dispensing brush also includes a stem sealing arrangement which includes a sealing boss which extends into the hollow stem and a shut-off member which depends from the sealing boss into the hollow stem.

17 Claims, 4 Drawing Sheets

PASTE DISPENSING BRUSH

CROSS REFERENCE TO RELATED APPLICATION

The present application claims the benefit of U.S. Provisional Patent Application No. 60/066,529 filed on Nov. 25, 1997, the disclosure of which is hereby incorporated by reference.

FIELD OF THE INVENTION

The invention relates to a paste dispensing brush, and, more specifically, to a toothbrush with a paste cartridge and a pump for dispensing paste from the cartridge onto the brush.

BACKGROUND OF THE INVENTION

Paste dispensing toothbrushes, such as those shown in U.S. Pat. No. 4,135,831 to Reitknecht, U.S. Pat. No. 4,269,207 to Konrad et al. and U.S. Pat. No. 4,201,490 to D'angelo, are known in the prior art but have experienced only moderate success because of several limitations of their designs. A significant limitation of these designs is that they require, at a minimum, three steps to operate. Before these brushes can be used, the hole(s) opening in the bristles must be opened, a knob at the base of the brush must be turned to dispense toothpaste into the bristles and then finally the hole(s) must be closed again. These steps require multiple manipulations of the toothbrush thus making these brushes commercially undesirable compared to using inexpensive existing toothbrushes with a separate toothpaste container.

Prior paste dispensing toothbrushes generally dispense toothpaste by using a knob at the end of the brush which rotates a cylinder on a threaded shaft. This complicated mechanism consists of several parts, is expensive to manufacture and prone to breaking.

In designs which do not have a mechanical expedient for forcing the toothpaste from the paste container, such as those which have a collapsible paste container, the units do not provide for positive dispensing of the paste and are susceptible to inadvertent dispensing of paste.

U.S. Pat. No. 5,158,383 to Glover et al. discloses a paste dispensing toothbrush with a hollow stem with a bristled head, open bottom and discharge aperture at the bristled head. A cartridge for containing paste is attached to the open bottom of the hollow stem and a hollow pump piston is disposed in the hollow stem and is slideable between an open and a closed position. A button extends through the stem and engages with the pump piston such that when the button is pressed, the pump piston simultaneously moves to the open position and dispenses paste.

However, one limitation of this design is that when the button is depressed, toothpaste can leak from the stem area back into the pump housing. This can contaminate and clog the device and make it more difficult to use. In addition, the contamination can accumulate and eventually extrude out around the button.

SUMMARY OF THE INVENTION

One aspect of the present invention provides a stem sealing arrangement for a paste dispensing brush having a paste reservoir and a reciprocating pump for dispensing the paste to a brush. The pump includes a housing defining a housing cavity and a piston mounted for reciprocating movement within the cavity, the piston separating the housing cavity into a pumping chamber portion and a dry portion.

The stem sealing arrangement includes a stem depending from the housing and having proximal and distal end portions, the distal end portion of the stem defining at least one discharge aperture. The stem has a longitudinal bore extending from the proximal end portion and communicating with the at least one discharge aperture.

The sealing arrangement further includes a sealing boss having a proximal end and a distal end, the sealing boss extending from the piston into the longitudinal bore at the proximal end portion of the stem to create a seal in the longitudinal bore at the proximal end portion of the stem. The sealing boss defines an interior channel therethrough communicating with the pumping chamber at the proximal end of the sealing boss and with the longitudinal bore at the distal end of the sealing boss.

The sealing arrangement also includes a shut-off member having a proximal end and a distal end, the shut-off member depending from the distal end of the sealing boss and extending through the longitudinal bore in the stem to the at least one discharge aperture. The shut-off member has a shut-off surface for selectively closing the at least one discharge aperture.

In operation, paste pumped by the reciprocating movement of the piston passes from the pumping chamber portion of the housing cavity through the interior channel of the sealing boss, through the longitudinal bore, and through the discharge aperture, and is prevented by the sealing boss from entering the dry portion of the housing cavity.

The longitudinal bore at the proximal end portion of the stem may have a D-shaped cross-section which is untapered. Additionally, the shutoff member may have a T-shaped cross section in a transverse plane adjacent the at least one discharge aperture.

The stem may also include a shut-off surface in the longitudinal bore at the distal end portion of the stem adjacent the discharge aperture, wherein a portion of the longitudinal bore is tapered, with a small end of the tapered portion being adjacent the discharge aperture, and wherein the shutoff member is tapered with the distal end of the shutoff member being smaller. The shut-off surface of the shut-off member is urged against the shut-off surface of the stem as the shut-off member is urged into the longitudinal bore.

The seal may comprise a raised annular ridge on an outer surface of the boss, the ridge having an interference fit in the longitudinal bore at the proximal end portion of the stem.

The piston, the sealing boss and the shut-off member may be a single, integrally formed part. In addition, the housing and the outer stem may be a single, integrally formed part.

A further aspect of the invention provides a paste dispensing brush including a stem having proximal and distal end portions, the distal end portion of the stem having bristles extending therefrom and defining at least one discharge aperture adjacent the bristles. The stem further defines a longitudinal bore extending from the proximal end portion and communicating with the at least one discharge aperture.

The paste dispensing brush further includes a pump housing having a first end portion and a second end portion. The proximal portion of the stem depends from the second end portion of the pump housing and the pump housing defines an interior chamber communicating with the longitudinal bore of the stem.

The paste dispensing brush further includes a piston having first and second ends, the piston disposed in the chamber of the pump housing for reciprocal movement therein, the piston defining an interior pumping chamber.

A sealing boss having a proximal end and a distal end is also included in the paste dispensing brush. The sealing boss extends from the second end of the piston into the longitudinal bore at the proximal end portion of the stem to create a seal in the longitudinal bore at the proximal end portion of the stem. The sealing boss defines an interior channel therethrough communicating with the pumping chamber at a proximal end of the boss and with the longitudinal bore at a distal end of the boss.

The paste dispensing brush further includes a shut-off member having a proximal end and a distal end, the shut-off member depending from the distal end of the sealing boss and extending through the longitudinal bore in the stem to the at least one discharge aperture. The shut-off member has a shut-off surface for selectively closing the at least one discharge aperture.

In operation, paste pumped by the reciprocating motion of the piston passes from the pumping chamber through the interior channel of the sealing boss, through the longitudinal bore, and through the discharge aperture, and is prevented by the sealing boss from passing between the longitudinal bore and the sealing boss.

The additional features described above with respect to the first aspect of the invention may also be included with this aspect of the invention. Additionally, the second end portion of the paste dispensing brush may be adapted to have secured thereto a cartridge for containing an extrudable material, such as toothpaste. Further, the piston and the pump housing may cooperate to form a sliding seal therebetween.

The paste dispensing brush may comprise a spring for urging the piston, the boss and the shut-off member to a position whereby the at least one discharge aperture is closed by the shut-off member. Additionally, the spring may have a line of force acting through a center of the piston.

Further, the paste dispensing brush may comprise a button depending from the piston and extending through a hole in the housing.

BRIEF DESCRIPTION OF THE DRAWINGS

Further objects, features and advantages of the present invention will be more readily apparent from the detailed descriptions of the preferred embodiments set forth below, taken in conjunction with the accompanying drawings in which.

DETAILED DESCRIPTION OF THE PREFERRED EMBODIMENTS

Figure 1:
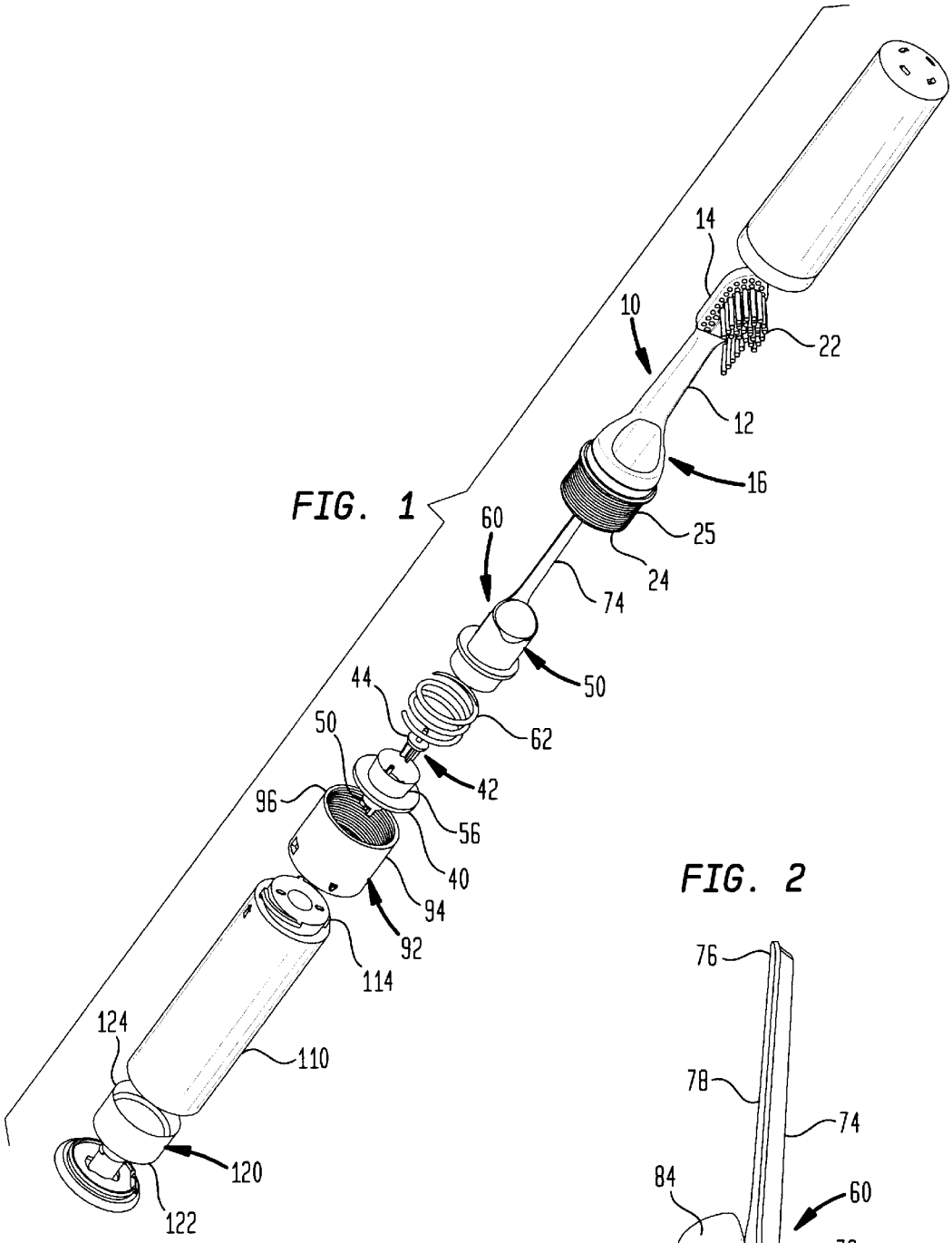
FIG. 1 is an exploded view of a paste dispensing brush according to one embodiment of the present invention.
Figure 7:
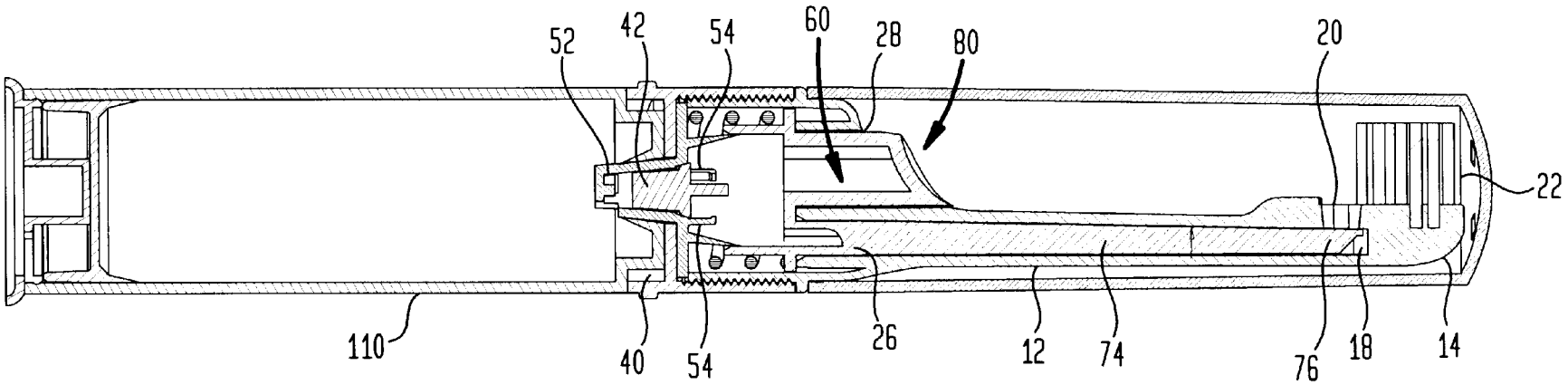
FIG. 7 is a sectional view of the paste dispensing brush shown in FIG. 1.
Figure 8:
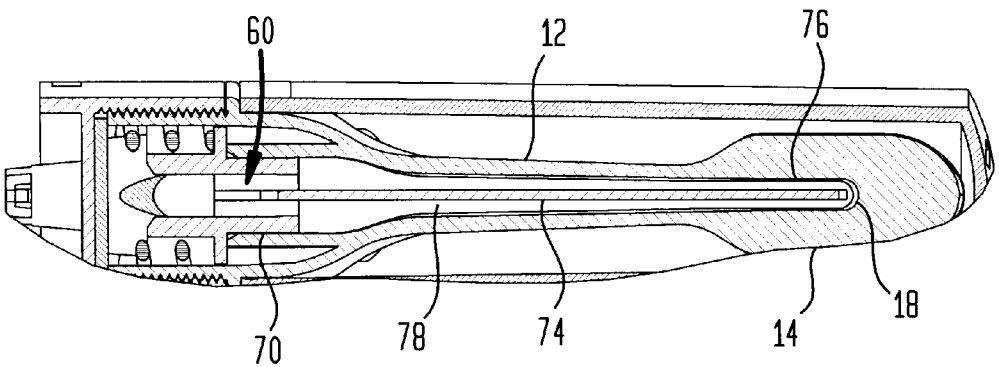
FIG. 8 is a further sectional view of the paste dispensing brush shown in FIG. 1.
Figure 9:
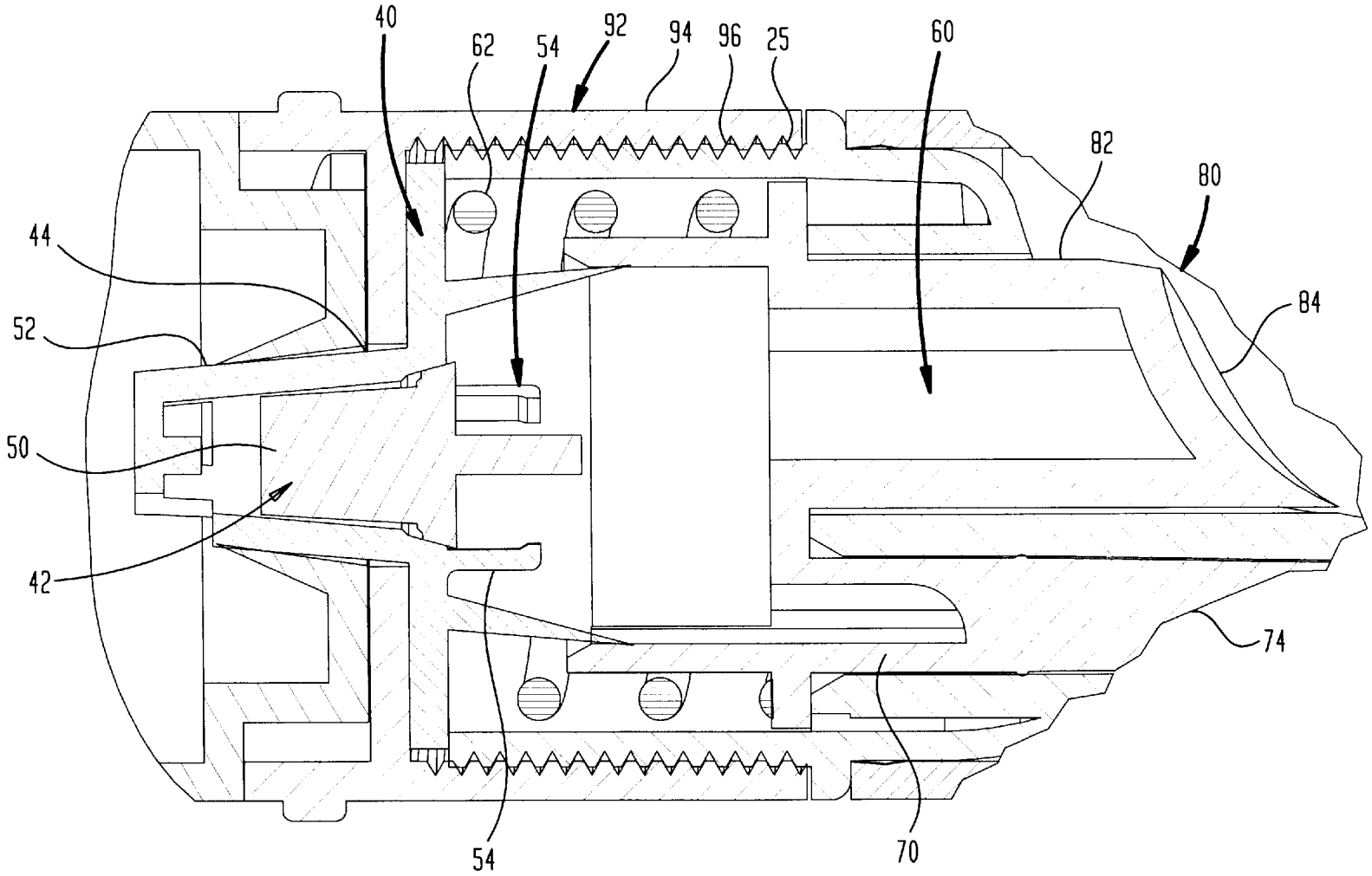
FIG. 9 is an enlarged partial sectional view of the sealing assembly of the paste dispensing brush shown in FIG. 7.

Referring to FIG. 1, there is shown an exploded view of a paste dispensing brush according to one embodiment of the present invention. The toothbrush 10 of the invention includes a tapered stem element 12 having an integral brush head 14 at the smaller end and having an integral pump housing 16 at the other end. The stem element 12 is generally D-shaped in cross-section, and has a bore 18 running from the pump housing 16, through the stem 12 to a dispensing aperture 20 within the brush head. (See FIG. 7). The dispensing aperture 20 is roughly perpendicular to the stem bore 18, and forms an opening among at least a portion of the bristles 22 of the brush head 14. The bore 18 has a substantially constant D-shaped cross-sectional area for a short distance starting at the pump housing 16, and then decreases in cross-sectional area as it extends in the direction of the brush head 14. While in the preferred embodiment the bore 18 is untapered at the pump housing 16, the bore 18 can be of any suitable shape.

The pump housing 16 comprises a generally cylindrical wall 24 that is open on the bottom and has two apertures 26 and 28. Aperture 26 communicates directly with the D-shaped bore 18 of the stem 12, and aperture 28 provides an opening for a button 80, as described below.

The open lower end of the pump housing is closed off by a disk-shaped cap 40, having a check valve 42 at its center. (See FIGS. 1, 3–5). The check valve 42 comprises a disk-shaped valve 44 with a beveled edge 46 that mates with a tapered hole 48 in the cap 40. The valve 42 permits flow of paste from a cartridge 110 into the pump housing 16, and prevents flow downward out of the pump housing 16. The valve 42 has a cross-shaped orienting member 50 protruding downward that fits into a hollow, conical wall 52 extending downward from the disk-shaped cap 40. The orienting member 50 orients the valve 42 in its seat. Three restraining prongs 54 protrude upwardly from the disk-shaped cap 40 and retain the valve 42 within the conical wall 52.

Figure 2:
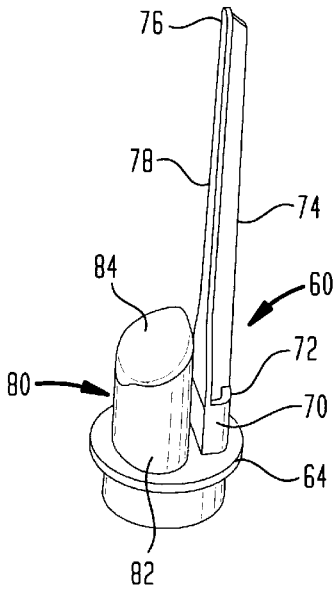
FIG. 2 is an elevational view of elements of a paste dispensing brush in accordance with the embodiment shown in FIG. 1.
Figure 3:
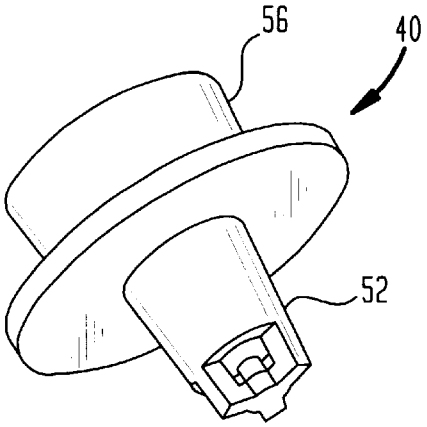
FIG. 3 is an elevational view of elements of a paste dispensing brush in accordance with the embodiment shown in FIG. 1.
Figure 4:
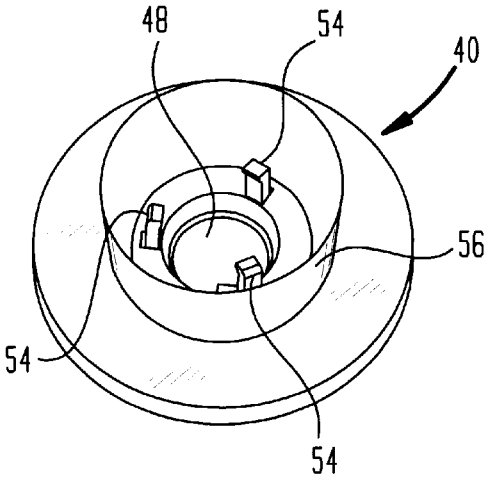
FIG. 4 is a further elevational view of the elements of a paste dispensing brush shown in FIG. 3.
Figure 5:
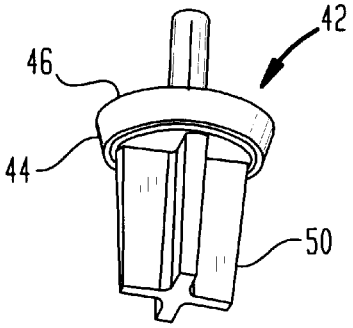
FIG. 5 is an elevational view of elements of a paste dispensing brush in accordance with the embodiment shown in FIG. 1.

A spring-loaded piston 60 (FIG. 2) is slideably mounted within the pump housing 16. The piston 60 is urged upwardly by a compression spring 62 on its outer diameter, acting between the disk-shaped cap 40 and an annular lip 64 on the piston 60. Because the compression spring 62 is centered on the piston 60, the upward force on the piston 60 is even, providing smooth up-and-down movement.

An annular piston sealing flange 56 protrudes upwardly from the disk-shaped cap 40. The piston sealing flange 56 seals within an internal cylindrical surface that opens downwardly from the piston 60. The piston sealing flange 56 fits tightly within the piston internal surface and is expanded against the surface by internal pressure of the paste during a pumping stroke.

The piston 60 includes an elongate, generally D-shaped piston extension 70 or sealing boss which protrudes upwardly, and has an external shape fitting closely with the straight, generally D-shaped portion of the stem bore 18. (FIGS. 2 and 7–9). The extension 70 has an annular, raised ridge 72 completely surrounding the D-shaped external profile of the extension 70. That ridge 72 forms an interference fit with the D-shaped bore 18 of the stem 12, assuring a positive seal around the stem 12 to prevent paste from being extruded back around the extension 70 into a dry portion of the interior of the pump housing 16 above the piston 60. Of course, any other expedient may be used to form a seal in the bore 18, including the body of the piston extension itself.

Extending upward from the D-shaped extension 70 of the piston 60 is a brush aperture blocking member 74 having a T-shaped cross-section and extending throughout the length of the stem bore 18 into the brush head 14. The support rib 78 forming the top of the "T" gradually decreases in width as it approaches the brush head 14. The blocking member 74 terminates in the brush area with a flat region 76 (the top of the "T") configured to shut off the aperture 20 in the brush head 14, thus preventing leakage of paste and protecting the paste in the area from exposure to ambient air. The paste flows within the stem bore 18 around the T-shaped cross-section of the blocking member 74, and exits aperture 20 when the piston 60 is moved downward to open aperture 20. When the piston 60 is in a fully upward position, the rib 78 meets with a matching taper in the stem bore 18 in order to positively seal the flat region 76 of the blocking member 74 against a small shelf area surrounding the aperture 20.

Button 80 comprises a closed, hollow member 82 with a contoured top surface 84 for pressing with the finger. (See FIGS. 2, 7 and 9). The button 80 extends through the aperture 28 provided in the top of the pump housing 16 for that purpose. The button 80 cross-section closely matches the cross-section of the aperture 28 in the pump housing 16, although no positive seal need be provided.

Button 80, D-shaped piston extension 70 and T-shaped blocking member 74 of the piston 60 are formed as a single, injection molded plastic part. This offers considerable cost savings in both molding and assembly, and increases reliability. In a preferred embodiment, this part is formed from medium grade TEXTIN® 5370 polyurethane having 70 shore durometer, or a sanoprene thermoplastic rubber. However, this part may be made from any suitable material which has properties similar to the above material.

Figure 6:
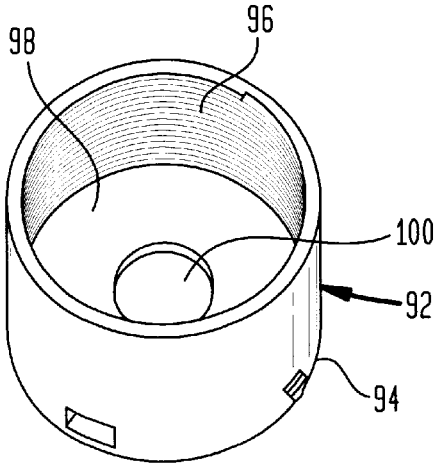
FIG. 6 is an elevational view of elements of a paste dispensing brush in accordance with the embodiment shown in FIG. 1.

The disk-shaped cap 40 is maintained securely in place against the lower edge of the pump housing 16 by a joining member 92, as shown in FIG. 6. The joining member 92 has an upper cylindrical wall 94 with internal threads 96 matching external threads 25 on the pump housing 16. A flat floor 98 at the bottom of the upper cylindrical wall 94 retains the disk-shaped cap 40 in place. The floor 98 has a central hole 100 for clearing the downwardly-extending conical wall 52 of the cap 40. The spring 62 for urging the piston 60 upward is partially compressed during assembly by threading the joining member 92 onto the pump housing 16. The threads 96 and 25 may thereafter be permanently joined, for example, by sonic welding or by using an adhesive.

A replacement cartridge 110 attaches below the joining member 92 using a bayonet-type mount or any other suitable joining expedient. The cartridge 110 has an annular sealing wall 114 that seals around the conical member 52 containing the check valve 42. In the case of separately sold replacement cartridges, a cap may be provided for the cartridge 110 to protect is contents until it is attached to the paste dispensing brush. The cap has a conical protrusion similar in shape to the hollow conical wall containing the check valve, for sealing the replacement cartridge prior to use.

The replacement cartridge 110 has a secondary piston 120 having two annular lips 122 and 124 for sealing and sliding within the inner bore of the replacement cartridge 110. The lower lip 122 of the secondary piston 120 is provided with an interference fit against the inner wall of the cartridge 110. The inner wall of the cartridge 110 is tapered slightly, with its smaller diameter at the base of the cartridge 110. The combination of the interference fit of the lower lip 122 with the slight taper prevents the secondary piston 120 from moving in the downward direction. Further, due to the action of the check valve 42, little or no positive pressure is exerted on the paste within the cartridge 110, so little downward force is exerted on the secondary piston 120 during the pumping cycle. This eliminates the necessity for a positive one-way mechanism, such as stainless steel spider, mounted to the secondary piston 120. The use of the one-way check valve 42 therefore results in significant cost savings.

The upper lip 124 of the secondary piston 120 seals the paste within the cartridge 10. The secondary piston 120 is drawn upward by suction applied to the paste within the cartridge 110 by upward movement of the piston 60 from the force of the compression spring 62 on the piston 60.

A dental floss dispenser or a musical chip may be installed in the base of the replacement cartridge 110 as an optional feature of the toothpaste dispenser. Such features are placed in the lower part of the cartridge 110, below the secondary piston 120.

To operate the dispensing toothbrush 10, the button 80 is depressed downward into the pump housing 16, moving the piston 60 downward and compressing the compression spring 62. Paste beneath the piston 60 is subjected to positive pressure, which closes the check valve 42 and forces paste through the D-shaped bore 18 in the extension 70 on top of the piston 60. As the piston 60 moves in a downward direction, the T-shaped blocking member 74 also moves downward, opening the aperture 20 in the brush head 14. Paste is forced through the stem 12 and through the aperture 20 into the brush head 14. The paste is prevented from leaking back around the piston extension 70 by the raised ridge 72 around the extension 70. Toothpaste is thereby substantially prevented from contaminating a dry portion of the interior of the pump housing 16 above the piston 60. Without the raised ridge 72, such contamination would accumulate in the otherwise dry portion of the pump housing 16 and eventually extrude out between the button 80 and the button hole 28.

When the button 80 is released, the compression spring 62 returns the piston 60 back to its original position. The reduced pressure within the piston 60 releases the check valve 42, and toothpaste is drawn from the cartridge 110, through the check valve 42 into the area beneath the piston 60. The reduced pressure within the cartridge 110 causes the secondary piston 120 to move upward in the cartridge 110 with the paste. The reduced cross-sectional area at the brush end of the stem 12 prevents a large flow of air into the stem 12 during the piston return cycle.

What is claimed is:

1. A stem sealing arrangement for a paste dispensing brush having a paste reservoir and a reciprocating pump for dispensing the paste to a brush, the pump having a housing defining a housing cavity, and a piston mounted for reciprocating movement within the cavity, the piston separating the housing cavity into a pumping chamber portion and a dry portion, the stem sealing arrangement comprising:

(a) a stem depending from said housing and having proximal and distal end portions, said distal end portion of said stem defining at least one discharge aperture, said stem having a longitudinal bore extending from said proximal end portion and communicating with said at least one discharge aperture;

(b) a sealing boss having a proximal end and a distal end, said sealing boss also having a raised annular ridge, said sealing boss extending from the piston into said longitudinal bore at said proximal end portion of said stem, said raised annular ridge forming an outer surface of said sealing boss forming an interference fit in said longitudinal bore at said proximal end portion of said stem to create a seal in said longitudinal bore at said proximal end portion of said stem, said sealing boss defining an interior channel therethrough communicating with said pumping chamber at said proximal end of said sealing boss and with said longitudinal bore at said distal end of said sealing boss; and (c) a shut-off member having a proximal end and a distal end, said shut-off member depending from said distal end of said sealing boss and extending through said longitudinal bore in said stem to said at least one discharge aperture, said shut-off member having a shut-off surface for selectively closing said at least one discharge aperture, whereby paste pumped by the reciprocating movement of the piston passes from the pumping chamber portion of the housing cavity through said interior channel of said sealing boss, through said longitudinal bore, and through said discharge aperture, and is prevented by said sealing boss from entering said dry portion of the housing cavity.

2. A sealing arrangement as claimed in claim 1, wherein said longitudinal bore at said proximal end portion of said stem has a D-shaped cross-section which is untapered.

3. A sealing arrangement as claimed in claim 1, wherein said shutoff member has a T-shaped cross-section in a transverse plane adjacent said at least one discharge aperture.

4. A sealing arrangement as claimed in claim 1, wherein said stem includes a shut-off surface in said longitudinal bore at said distal end portion of said stem adjacent said discharge aperture, wherein a portion of said longitudinal bore is tapered, with a small end of said tapered portion being adjacent said discharge aperture, and wherein said shutoff member is tapered, with said distal end of said shutoff member being smaller; whereby said shut-off surface of said shut-off member is urged against said shut-off surface of said stem as said shut-off member is urged into said longitudinal bore.

5. A sealing arrangement as claimed in claim 1, wherein the piston, said sealing boss and said shut-off member are a single, integrally formed part.

6. A sealing arrangement as claimed in claim 1, wherein the housing and said stem are a single, integrally formed part.

7. A paste dispensing brush, comprising:

(a) a stem having proximal and distal end portions, said distal end portion of said stem having bristles extending therefrom and defining at least one discharge aperture adjacent said bristles, said stem having a longitudinal bore extending from said proximal end portion and communicating with said at least one discharge aperture;

(b) a pump housing having a first end portion and a second end portion, said proximal portion of said stem depending from said second end portion of said pump housing, said pump housing defining an interior chamber communicating with said longitudinal bore of said stem;

(c) a piston having first and second ends, said piston disposed in said chamber of said pump housing for reciprocal movement therein, said piston defining an interior pumping chamber;

(d) a sealing boss having a proximal end and a distal end, said sealing boss also having a raised annular ridge, said sealing boss extending from said second end of said piston into said longitudinal bore at said proximal end portion of said stem, said raised annular ridge forming an outer surface of said sealing boss forming an interference fit in said longitudinal bore at said proximal end portion of said stem to create a seal in said longitudinal bore at said proximal end portion of said stem, said sealing boss defining an interior channel therethrough communicating with said pumping chamber at a proximal end of said boss and with said longitudinal bore at a distal end of said boss; and (e) a shut-off member having a proximal end and a distal end, said shut-off member depending from said distal end of said sealing boss and extending through said longitudinal bore in said stem to said at least one discharge aperture, said shut-off member having a shut-off surface for selectively closing said at least one discharge aperture, whereby paste pumped by the reciprocating motion of said piston passes from said pumping chamber through said interior channel of said sealing boss, through said longitudinal bore, and through said discharge aperture, and is prevented by said sealing boss from passing between said longitudinal bore and said sealing boss.

8. A paste dispensing brush as claimed in claim 7, wherein said longitudinal bore at said proximal end portion of said stem has a D-shaped cross-section which is untapered.

9. A paste dispensing brush as claimed in claim 8, wherein said shut-off member has a T-shaped cross section in a transverse plane adjacent said at least one discharge aperture.

10. A paste dispensing brush as claimed in claim 9, wherein said stem includes a shut-off surface in said longitudinal bore at said distal end portion of said stem adjacent said discharge aperture, wherein a portion of said longitudinal bore is tapered, with a small end of said tapered portion being adjacent said discharge aperture, and wherein said shutoff member is tapered, with said distal end of said shutoff member being smaller; whereby said shut-off surface of said shut-off member is urged against said shut-off surface of said stem as said shut-off member is urged into said longitudinal bore.

11. A paste dispensing brush as claimed in claim 9, wherein said piston, said sealing boss and said shut-off member are a single, integrally formed part.

12. A paste dispensing brush as claimed in claim 9, wherein said housing and said outer stem are a single, integrally formed part.

13. A paste dispensing brush as claimed in claim 9, wherein said second end portion of said pump housing is adapted to have secured thereto a cartridge for containing extrudable material.

14. A paste dispensing brush as claimed in claim 9, wherein said piston and said pump housing cooperate to form a sliding seal therebetween.

15. A paste dispensing brush as claimed in claim 9, further comprising a spring for urging said piston, said boss and said shut-off member to a position whereby said at least one discharge aperture is closed by said shut-off member.

16. A paste dispensing brush as claimed in claim 15, wherein said spring has a line of force acting through a center of said piston.

17. A paste dispensing brush as claimed in claim 9, further comprising a button depending from said piston and extending through a hole in said pump housing.

* * * * *